US005249700A

United States Patent [19]

Dumke

[11] Patent Number: 5,249,700

[45] Date of Patent: Oct. 5, 1993

[54] INTERFITTING PLATE AND CUP

[76] Inventor: Dan Dumke, Rte. 2, Box 118, Markesan, Wis. 53946

[21] Appl. No.: 934,331

[22] Filed: Aug. 25, 1992

[51] Int. Cl.[5] ..... B61D 1/36

[52] U.S. Cl. ..... 220/574; 220/23.86; 229/904

[58] Field of Search ..... 220/574, 875, 23.8, 220/23.84; 229/904; 206/217

[56] References Cited

U.S. PATENT DOCUMENTS

| | | | |
|---|---|---|---|
| 2,240,020 | 4/1941 | Raiser | 220/575 |
| 2,766,919 | 10/1986 | Randall | 229/904 |
| 2,833,458 | 5/1958 | Toensmeier | 229/904 |
| 3,005,584 | 10/1961 | Coe | 229/904 |
| 3,376,974 | 4/1968 | Hilliard | 206/562 |
| 4,156,484 | 5/1979 | Wischusen | 229/904 |
| 4,732,274 | 3/1988 | Bouton | 229/23.8 |
| 4,757,937 | 7/1988 | Maio et al. | 229/904 |
| 5,060,820 | 10/1991 | Boerner | 220/574 |
| 8,224,625 | 12/1965 | Sperl | 220/23.83 |

*Primary Examiner*—Joseph Man-Fu Moy
*Attorney, Agent, or Firm*—Donald Cayen

[57] ABSTRACT

An interfitting plate and cup enable a person to hold a food plate and a beverage cup with one hand. The plate has a central section with a hole therethrough. The hole is surrounded by a frusto-conical lip having a free edge that defines an opening for receiving the cup with the cup wall being supported on the lip free edge. In an alternate embodiment, the plate is formed with a ring of perforations in the central section. The plate may be used as a conventional plate, or the perforations can be punched out to create an opening for retaining a cup.

2 Claims, 1 Drawing Sheet

INTERFITTING PLATE AND CUP

BACKGROUND OF THE INVENTION

1. Field of the Invention

This invention pertains to eating utensils, and more particularly to plates and cups.

2. Description of the Prior Art

Dining plates and drinking cups are items of everyday knowledge and use. In the usual situation, a plate and cup rest on a firm horizontal surface in front of a person. Although they may be used at the same time, plates and cups normally exist and function independently of each other in a completely satisfactory manner.

However, on some occasions an important interplay arises between plates and cups. Those occasions occur when a suitable support surface is not available, at least temporarily, for supporting the plate and cup. In those situations, a person must hold both a plate and cup in her hands. If the person must simultaneously place food on her plate, as at picnics and buffet meals, the well known problem arises of trying to balance a plate of food and a cup of liquid with one hand while serving the food and/or drink with the other hand.

To solve the problem of balancing a plate and cup with one hand, various combination plate and cup assemblies have been proposed. Examples of prior plate and cup assemblies can be seen in U.S. Pat. Nos. 3,401,858; 3,955,672; 4,461,396; 4,966,297; 4,989,742; and 5,060,820. Some of the assemblies of the foregoing patents are rather impractical for informal use such as at picnics. Other assemblies are undesirably expensive due to the intricate nature of the various components.

U.S. Pat. Nos. 5,111,960 and 5,058,737 show plate and cup assemblies that require specially designed cups. That requirement diminishes the versatility and usefulness of both the cups and the plates.

U.S. Pat. Nos. 3,964,629 and 4,732,274 show trays formed with holes for holding paper cups. Neither of the above trays is suitable for holding food.

Thus, a need exists for a practical food plate capable of holding a drinking cup.

SUMMARY OF THE INVENTION

In accordance with the present invention, an economical and practical interfitting plate and cup are provided that conveniently enable a person to simultaneously carry the plate and cup with only one hand. This is accomplished by fabricating the plate with an opening therein that removably receives a tapered cup.

The plate may be of any desired size and shape. The plate has the usual flat central section and a sloped wall around its periphery. A hole extends through the plate flat central section. Surrounding the hole is an upstanding lip that is integrally joined to the plate central section. The lip preferably is formed as parallel frusto conical surfaces having a free edge and an apex that is located on the top side of the plate. The lip free edge defines an opening, which is sized to accept and hold a conventional tapered beverage cup. The plate may be manufactured from a variety of materials, such as paper and plastic.

For some applications, a lip around the plate opening may not be necessary. In those situations, plates made of paper may be manufactured such that the opening is not preformed. Rather, a circular ring of perforations can be applied to the plate material at manufacture. If no opening is desired in the plate at the time of its use, the user merely uses the plate in the normal manner. If an opening for a cup is desired, the person can create the opening by punching out the ring of perforations. The interfitting plate and cup of the present invention enable a person to hold both food and beverage with one hand while leaving her other hand free for other purposes. The plate can be made very economically to suit conventional tapered beverage cups.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
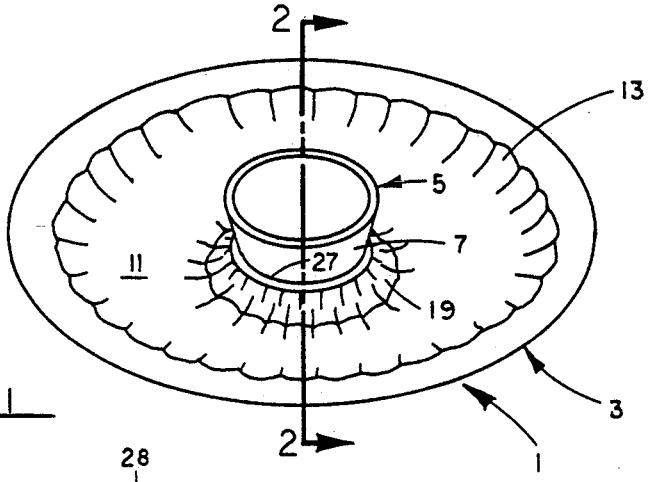
FIG. 1 is a perspective view of the interfitting plate and cup of the present invention.
Figure 2:
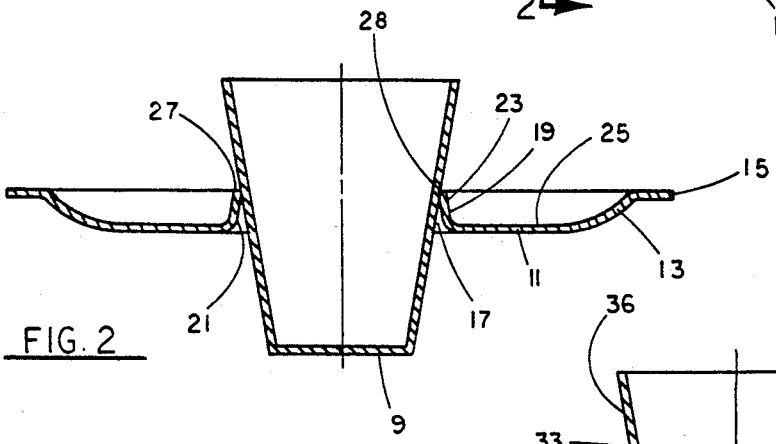
FIG. 2 is a partial cross sectional view taken along lines 2—2 of FIG. 1.

Referring to FIGS. 1 and 2, an interfitting plate and cup 1 are illustrated that include the present invention. The interfitting plate and cup are particularly useful for holding food and beverage at picnics and buffet meals, but it will be understood that the invention is not limited to use at informal occasions.

The interfitting plate and cup 1 is comprised of a plate 3 and a cup 5. The cup 5 may be any of a variety of conventional cups commercially available for holding hot and cold drinks. Such cups invariably have a frusto conical side wall 7 and a bottom wall 9.

The plate 3 has a flat central section 11 and a sloped peripheral wall 13. The peripheral 13 may end in a short flat rim 15.

In accordance with the present invention, the plate 3 is fabricated with a hole 17 through the central section 11 thereof. The hole 17 is designed to receive the cup 5. Although the hole is shown at the center of the plate central section, the hole may be located at any desired location within the central section.

The hole 17 is bounded by an annular lip 19 that is upstandingly joined to the plate central section 11. The lip 19 preferably has parallel frusto-conical inside and outside surfaces 21 and 23, respectively. The apex of the lip frusto-conical surfaces 21 and 23 is located above the top surface 25 of the plate central section. The height of the lip 19 above the plate central section is preferably no greater than the height of the peripheral wall 13 above the central section. With that design, the plates 3 of the present invention are stackable.

The lip 19 terminates in a free edge 27. The lip free edge 27 defines an opening 28 through which the cup 5 is inserted. The cup passes through the opening 28 until the cup side wall 7 contacts the free edge 27 of the lip. At that point, the cup is retained in the plate. By holding the plate 3 in a normal fashion a person simultaneously holds the cup As a result, she is able to stably hold both plate and cup with only one hand, leaving her second free to fill the plate with food and the cup with beverage or for other purposes.

Figure 3:
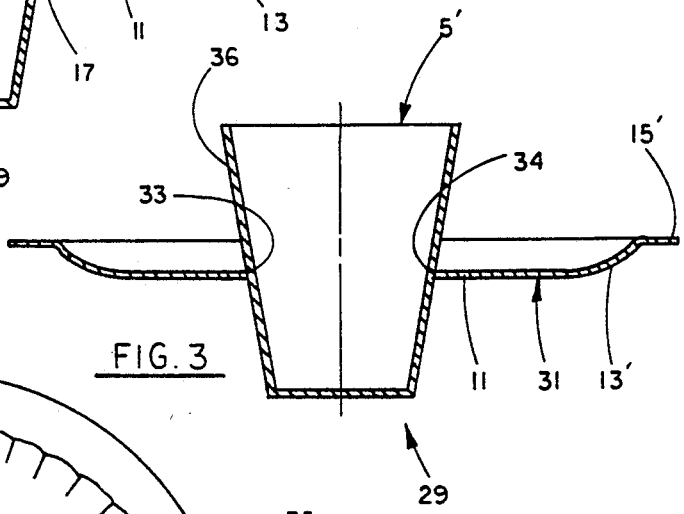
FIG. 3 is a view similar to FIG. 2, but showing a modified embodiment of the invention.

Looking at FIG. 3, an interfitting plate and cup 29 is shown that utilizes a conventional cup 5' and a modified plate 31. The plate 31 has a flat central section 11' and a sloped peripheral wall 13'. The plate central section 11' has an opening 33 through it. The opening 33 is defined by an edge 34 of the plate material, and the opening lies entirely in the plane of the central section 11'. That is, there is no lip around the opening 33. The opening is sized such that the cup 5' can pass partially through it until the cup wall contacts the plate edge 34. In that manner, the plate retains the cup 5'.

The plates 3 and 31 may be manufactured from any suitable material. Rigid plastic is suitable for reusable plates. Paper is suitable for disposable plates.

Figure 4:
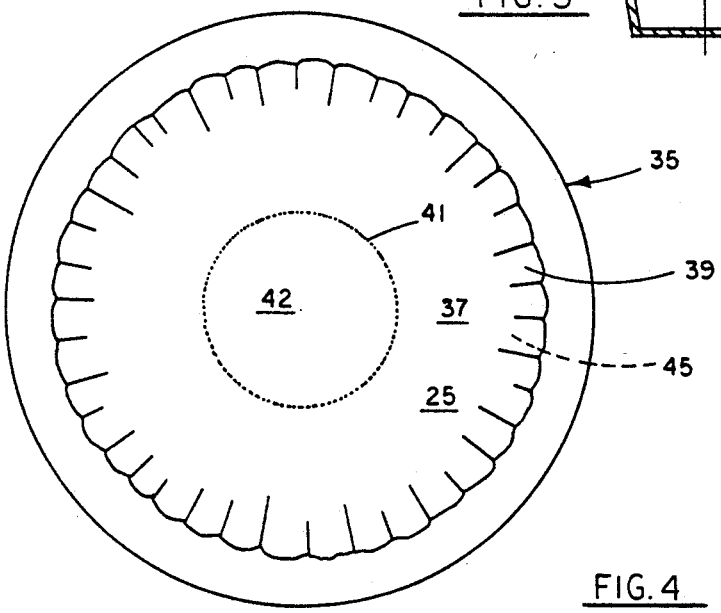
FIG. 4 is a top view of a further modified plate according to the present invention.

Turning to FIG. 4, a paper plate 35 is shown that is convertible between a conventional plate and a modified plate according to the present invention. The plate 35 has a central section 37 and a sloped wall 39 around the periphery of the central section. The central section 37 is continuous, but a ring of perforations 41 is stamped into the central section. The perforations 41 define a circle 42 of the plate material. The perforations may be stamped in either the top surface 25 of the central section or in the bottom surface 45, or in both surfaces. The circle 42 has a diameter generally equal to the diameter of the opening 33 of the plate 31 of FIG. 3.

The plate 35 is convertible between a conventional paper plate without any opening therethrough and a plate that is capable of holding a cup 5 or 5'. If a conventional plate is satisfactory for the circumstances at hand, a person merely uses the plate 35 as produced with the central section 37 intact. If, however, the person wants to hold a cup with the plate, she merely removes the circle 42 of material by punching out the ring of perforations 41. The plate is then capable of receiving and retaining a cup 5 or 5' in the same manner as the plate 3 of FIGS. 1 and 2 and the plate of 31 of FIG. 3.

Thus, it is apparent that there has been provided, in accordance with the invention, an interfitting plate and cup that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A food plate comprising:

a. a generally flat central section having top and bottom surfaces lying in respective flat planes and defining a hole therethrough, the bottom surface being free of any portion of the plate depending therefrom;

b. a peripheral wall around the central section; and c. a lip upstanding joined to the central section top surface and surrounding the hole, the lip terminating in a free edge that defines a plane that is non-intersecting with the plane of the central section top surface, the lip free edge defining an opening with a size and shape that enables a portion of a cup with a frusto-conical wall to pass through the opening with the lip free edge contacting the cup wall to retain the cup in the opening and prevent the cup from passing completely through the opening, so that the plate is suitable as a food plate and can support the cup by the lip free edge.

2. The food plate of claim 1 wherein the lip is defined by a pair of parallel frusto-conical surfaces having an apex that lies above the top surface of the plate central section.

* * * * *